United States Patent [19]

Hoyer

[11] Patent Number: 4,895,632

[45] Date of Patent: Jan. 23, 1990

[54] DEVICE FOR PROVIDING A STRIPE SHAPED COATING ON AN ELONGATED CONDUCTIVE STRIP BY AN ELECTROLYTIC PROCESS

[75] Inventor: Willem Hoyer, Hertogenbosch, Netherlands

[73] Assignee: MECO Equipment Engineers B.V., Hertogenbosch, Netherlands

[21] Appl. No.: 304,548

[22] Filed: Jan. 31, 1998

[30] Foreign Application Priority Data

Feb. 10, 1988 [NL] Netherlands ..... 8800317

[51] Int. Cl.[4] ..... C25D 17/00

[52] U.S. Cl. ..... 204/206

[58] Field of Search ..... 204/206

[56] References Cited

U.S. PATENT DOCUMENTS 4,431,500 1/1984 Messing ..... 204/206

OTHER PUBLICATIONS

Galvanotechnik, vol. 76, No. 12, Dec. 1985 (Saulgau, DE).

E. A. Sauter: "Grundgedanken der Selektivgalvanik", bladzijde 1946-1951, zie figuur 7.

*Primary Examiner*—T. M. Tufariello

*Attorney, Agent, or Firm*—Ladas & Parry

[57] ABSTRACT

Device for providing, by an electrolytic process, a stripe shaped coating on an elongated conductive strip, said strip being guided along a rotatable wheel and provided with means for moving the strip in its longitudinal direction, in such a way that over part of the path the strip travels against at least part of the outer circumference of the wheel, while at the side of the strip remote from the wheel a stationary masking strip is provided, which covers at least part of the part of the strip which is in contact with the wheel and which is provided with holes, so that via the holes an electrolyte can be brought into contact with the part of the strip which moves along the holes during operation. A groove, extending in the longitudinal direction of the masking strip is provided in the side of the masking strip directed towards the strip, the width of said groove being equal to the width of the coating to be provided on the strip, whilst the holes debouch into said groove.

10 Claims, 1 Drawing Sheet

DEVICE FOR PROVIDING A STRIPE SHAPED COATING ON AN ELONGATED CONDUCTIVE STRIP BY AN ELECTROLYTIC PROCESS

The invention relates to a device for providing, by an electrolytic process, a stripe shaped coating on an elongated conductive strip, said device being provided with a rotatable wheel and means for moving the strip in its longitudinal direction in such a way that over part of the path the strip travels against at least part of the outer circumference of the wheel, whilst at the side of the strip remote from the wheel a stationary non-conductive masking strip is provided, which covers the wheel and which is part of the strip which is in contact with the wheel and which is provided with holes, so that via the holes an electrolyte can be brought into contact with the part of the strip which moves along the holes during operation.

Such a device is known from the U.S. Pat. No. 4,431,500. In this known device the electrolyte comes into contact with an elongated conductive strip to be provided with a coating at the location of the holes. In view of the fact that the strip to be coated moves along the holes a stripe shaped coating will be provided on the strip in question during operation, in spite of the fact that the electrolyte can only come into contact with the strip via the holes provided in the stationary masking strip.

In practice it cannot be avoided that the electrolyte, which is jetted, e.g. by means of a sparger or the like, against the side of the masking strip remote from the strip to be provided with a coating, contains small unsoluble particles. Such particles can come into contact with the strip to be provided with a coating which moves along the masking strip and they may thereby become trapped at the edge of the hole provided in the masking strip or be dragged along by the moving strip and become embedded between the masking strip and the moving strip. It will be apparent that this may result in undesired damage to the coating and/or to the strip to be provided with the coating itself.

Moreover, there is a danger that during the passage of the elongated conductive strip under the non-perforated part of the masking strip passivity of the metal coating is created, resulting in coatings which do not adhere or adhere badly. This danger is especially large with coatings consisting of nickel.

The disadvantages of said known device is avoided when the device which is known from the U.S. Pat. No. 3,819,502 is used, in which device the masking strip moves along with the strip to be provided with a coating. When a device according to the U.S. Pat. No. 3,819,502 is used a product of a considerably better quality will therefore be obtained than when the device according to the U.S. Pat. No. 4,431,500 is used. The application of a masking strip with moves along with the elongated conductive strip requires a more expensive construction of the device, however, which also leads to higher costs of the product manufactured with the device.

The purpose of the invention is to obtain a device in which the disadvantages of the device according to the U.S. Pat. No. 4,431,500 can be avoided, while maintaining a simple and inexpensive construction of the device, so that it will still be possible to make products of a quality which is acceptable for many applications, even though said products may not yet satisfy the high standards which may be set for products made by using a device according to the U.S. Pat. No. 3,819,502.

According to the invention this may be achieved by providing a groove, extending in the longitudinal direction of the masking strip, in the side of the masking strip directed towards the strip, the width of said groove being equal to the width of the coating to be provided on the strip, whilst the holes debouch into said groove.

When using the construction according to the invention any small impurities which may be present in the electrolyte may be received in the groove, without becoming wedged between the masking strip and the strip to be provided with a coating which moves along the masking strip, so that undesired damage to the coating or to the strip is avoided.

An additional advantage of the device according to the invention is thereby that the electrolyte does not only come into contact with the strip to be coated at the location of the holes, as in the device according to the U.S. Pat. No. 4,431,500, but along the entire length of the groove provided in the strip, as a result of which it is at the same time prevented that the metal coating becomes passive.

This is especially important when nickel coatings are plated.

A further advantage of the device according to the invention is that also elongated conductive strips provided with a fragile stamping pattern can be treated without any risk of deformation, because the fragile patterns are not touched during their passage under the grooved masking strip.

Finally the device according to the invention makes it possible to make the groove wider than the width of the pattern of holes. The stripe shaped pattern thus provided on the elongated conductive strip will then centrally show the desired stripe pattern at its full thickness and a very thin layer at one or both sides. Such thin tapered layers are called "flash plating" and they are often required. With the existing devices passage through two devices arranged in tandem is necessary for providing such patterns.

The invention will be further explained hereinafter with reference to an embodiment of the construction according to the invention diagrammatically illustrated in the accompanying figures.

FIG. 1 diagrammatically illustrates a device according to the invention.

Figure 4:
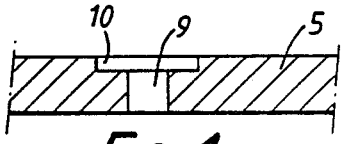
FIG. 4 is a larger-scale cross-section of a part of a masking strip, the width of the groove being greater than the width of the pattern of holes.
Figure 3:
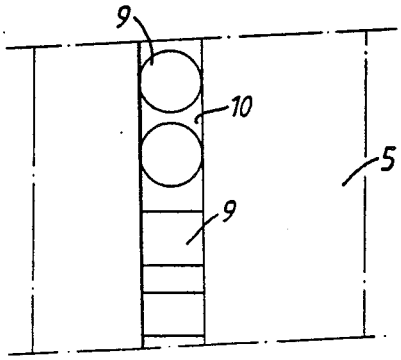
FIG. 3 is a plan view of the masking strip according to FIG. 2 indicating circular as well as rectangular holes.
Figure 5:
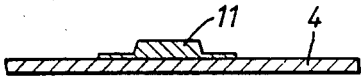

FIG. 5 diagrammatically illustrates the construction of the metal coating obtained with the masking strip according to FIG. 4.

Figure 1:
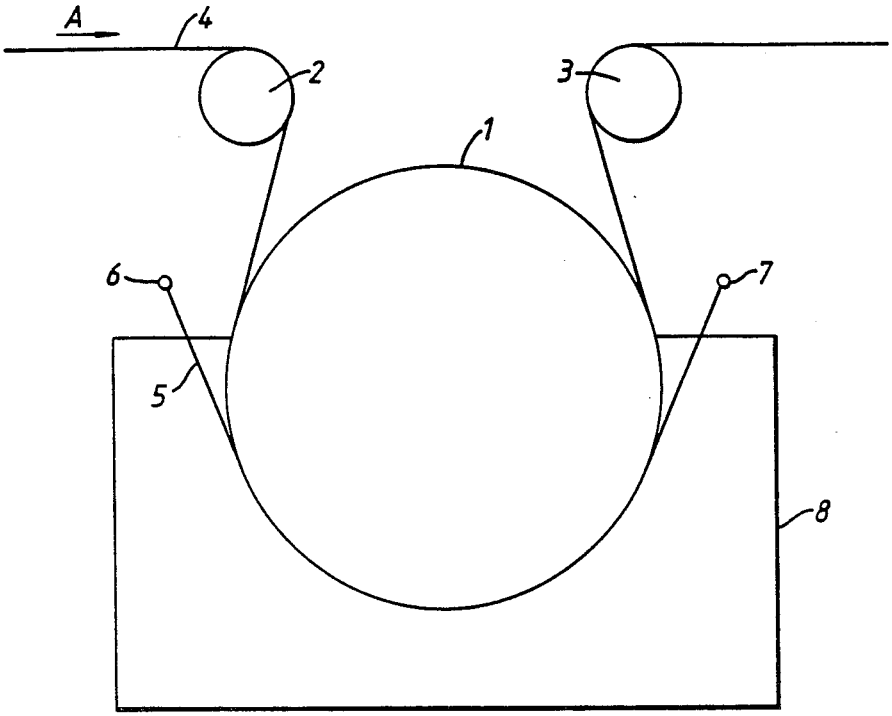
Figure 2:
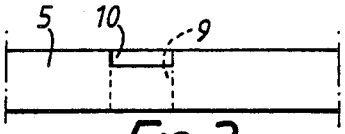
FIG. 2 is a larger-scale cross-section of a part of the masking strip.

The device illustrated in FIG. 1 comprises a wheel 1 which is rotatable about a horizontal axis of rotation, a part of a strip 4 extending along its outer circumference. The strip 4 is furthermore guided along guide wheels 2 and 3.

During operation the strip can be moved in its longitudinal direction, in the direction according to arrow A, by means of driving means (not shown), whereby at the same time the wheel 1 will be rotated about its axis of rotation and whereby always an other part of the strip will lay closely against the outer circumference of the wheel.

At the side remote from the wheel 1 a masking strip 5 covers a part of the part of the strip 4 which lays against the outer circumference of the wheel 1. Said stationary masking strip 5 is fixed with its end in fixed connection points 6 and 7, with which the tension of the masking strip can be adjusted.

The wheel is arranged, at least with its lower part, in a container 8 in which means (not shown) are arranged, by which electrolyte can be jetted against the part of the masking strip 5 which is in contact with the strip 4. An embodiment of such a device is further elaborated in the above-mentioned U.S. Pat. No. 4,431,500.

In the part of the masking strip 5 covering the strip 4 a number of regularly spaced holes 9 are provided, which holes may e.g. be circular, rectangular or oval. Said holes 9 debouch, at the side of the masking strip directed towards the strip 4, into a groove 10 extending in the longitudinal direction of the masking strip 5. During operation the electrolyte will flow into the groove 10 extending in the longitudinal direction of the masking strip, so that during operation the electrolyte will come into contact, at the location of said groove, with the strip 4 moving along the masking strip 5, in order to provide a stripe shaped coating on said strip 4, all this as described in the above-mentioned U.S. Pat. No. 4,431,500.

As already explained, as a result of the application of said groove extending in the longitudinal direction of the masking strip 5 it is prevented that any small particles present in the electrolyte become wedged between the masking strip 5 and the strip 4 moving along said masking strip 5.

FIG. 4 illustrates an embodiment in which the width of the groove 10 in the masking strip is greater than the width of the pattern of holes. FIG. 5 diagrammatically illustrates in cross-section the shape of the metal coating 11 obtained by means of said embodiment, which coating is illustrated too thick for the sake of clarity. As indicated here a thick layer is centrally formed in this embodiment with a thin layer on both sides. By providing the holes 9 at one side of the groove 10 only, a pattern may be obtained in which a thin layer is formed at only one side of the thick layer.

It will be apparent that when more than one stripe shaped coating must be provided on an elongated conductive strip the device according to the invention can be provided with masking strips having several parallel rows of holes and grooves in order to provide the desired multiple stripe shaped patterns in one passage. It will be possible thereby to produce stripes of mutually different widths.

I claim:

1. Device for providing, by an electrolytic process, a stripe shaped coating on an elongated conductive strip, said strip being guided along a rotatable wheel and provided with means for moving the strip in its longitudinal direction, in such a way that over part of the path the strip travels against at least part of the outer circumference of the wheel, while at the side of the strip remote from the wheel a stationary masking strip is provided, which covers at least part of the part of the strip which is in contact with the wheel and which is provided with holes, so that via the holes an electrolyte can be brought into contact with the part of the strip which moves along the holes during operation, characterized in that a groove, extending in the longitudinal direction of the masking strip, is provided in the side of the masking strip directed towards the strip, the width of said groove being equal to the width of the coating to be provided on the strip, while the holes debouch into said groove.

2. Device according to claim 1, characterized in that the width of a hole measured transversely to the longitudinal direction of the masking strip is at least substantially equal to the width of the groove.

3. Device according to claim 1, characterized in that the width of the hole measured in the transverse direction of the masking strip is smaller than the width of the groove.

4. Device according to claim 3, characterized in that the holes are arranged centrally relative to the longitudinal axis of the groove.

5. Device according to claim 3, characterized in that the holes are arranged near the side of the groove.

6. Device according to claim 1, characterized in that several grooves extending parallel to one another are provided in the masking strip, while holes debouch into each of said grooves.

7. Device according to claim 2, characterized in that several grooves extending parallel to one another are provided in the masking strip, while holes debouch into each of said grooves.

8. Device according to claim 3, characterized in that several grooves extending parallel to one another are provided in the masking strip, while holes debouch into each of said grooves.

9. Device according to claim 4, characterized in that several grooves extending parallel to one another are provided in the masking strip, while holes debouch into each of said grooves.

10. Device according to claim 5, characterized in that several grooves extending parallel to one another are provided in the masking strip, while holes debouch into each of said grooves.

* * * * *

UNITED STATES PATENT AND TRADEMARK OFFICE

CERTIFICATE OF CORRECTION

PATENT NO. : 4,895,632

DATED : January 23, 1990

INVENTOR(S) : William Hoyer

It is certified that error appears in the above-identified patent and that said Letters Patent is hereby corrected as shown below:

On the title page, after "code [22] Filed: ", the filing date should be corrected to read -- Jan. 31, 1989 --.

Signed and Sealed this

Seventh Day of January, 1992

*Attest:*

*Attesting Officer*

HARRY F. MANBECK, JR.

*Commissioner of Patents and Trademarks*